US006289567B1

(12) United States Patent
Robertson

(10) Patent No.: US 6,289,567 B1
(45) **Date of Patent: *Sep. 18, 2001**

(54) METHOD OF MAKING A PERSONALIZED PICTURE FRAME THAT IS AN EXTENSION OF THE DISPLAYED PHOTOGRAPH

(76) Inventor: Mari-Lyn Robertson, 5727 Adobe Falls Rd., No. C, San Diego, CA (US) 92120

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/114,035

(22) Filed: Jul. 10, 1998

(51) Int. Cl.[7] ..... A47G 1/06

(52) U.S. Cl. ..... 29/415; 29/428; 40/700; 40/743; 40/768

(58) Field of Search ..... 40/768, 743, 771, 40/773, 798, FOR 158.1, 700, 702, 772, 777; 29/428, 445, 415, 416

(56) References Cited

U.S. PATENT DOCUMENTS

| | | | | |
|---|---|---|---|---|
| D. 383,613 | | 9/1997 | Handler . | |
| 1,427,874 | | 9/1922 | Weaver . | |
| 1,628,640 | | 5/1927 | Baldwin . | |
| 1,917,922 | | 7/1933 | Clark . | |
| 3,736,684 | * | 6/1973 | Grad | 40/700 |
| 3,868,283 | | 2/1975 | Scheyer . | |
| 4,176,452 | * | 12/1979 | Duggins et al. | 30/293 |
| 4,393,612 | * | 7/1983 | Clark | 40/768 |
| 5,248,536 | * | 9/1993 | Du Katz | 40/700 |
| 5,421,583 | | 6/1995 | Gluck . | |
| 5,720,123 | | 2/1998 | Taylor . | |
| 5,783,005 | * | 7/1998 | Handler | 40/700 |
| 5,822,895 | * | 10/1998 | Risdal | 40/718 |

OTHER PUBLICATIONS

Photographs of Anne Geddes Photographic Frame Print, by Anne Geddes, 1997.*

Photographs of Anne Geddes Photographic Frame Print, by Anne Geddes, untitled, © 1997.

* cited by examiner

*Primary Examiner*—Lee Young
*Assistant Examiner*—A. Dexter Tugbang
(74) *Attorney, Agent, or Firm*—Fitch, Even, Tabin & Flannery

(57) ABSTRACT

A method of personalizing a photograph display frame consists of the steps of: providing a photograph display frame having a perimeter, a central opening, a front surface, a rear surface and a thickness; providing a photographic image depicted in two portions, a first portion sized to cover the front surface of the frame and a second portion sized to at least fit the central opening of the frame; attaching the first portion to the frame; and positioning the second portion in the opening separated at least by the thickness of the frame from the first portion such that the first portion and second portion are in plan view alignment.

14 Claims, 2 Drawing Sheets

METHOD OF MAKING A PERSONALIZED PICTURE FRAME THAT IS AN EXTENSION OF THE DISPLAYED PHOTOGRAPH

BACKGROUND OF THE INVENTION

The present invention relates to a picture frame for displaying a photograph, and more particularly, to a picture frame that complements the displayed photograph. Even more particularly, the present invention relates to an apparatus and method of construction of a personalized picture frame that is an extension of the displayed photograph.

Traditional picture frames are typically used to display a persons photographs. There are wide varieties of frames used to display photographs including flat, carved and sometimes ornate frames. Some of the frames have three dimensional characteristics in the form of beveling or molding or even carved relief images or carved ornamentation. The frames also can vary in shape from square, rectangular, oval, round or a custom shape. While there is this wide selection of frames available, the typical picture frame used to display a persons photographs is of the flat variety. This means that the frame has a flat surface surrounding the photograph and the photograph is usually covered with glass.

Typically, photograph frames are purchased at a store in a pre-manufactured form. In some cases, an individual desires to personalize the photo frame. Items such as beveling or molding are difficult to add to a frame, so the person's selection is limited to the size, color and shape of the frame. Matting sometimes is used between the photograph and the frame for decorative purposes. Ideally, the person desires a frame that does not distract or overwhelm the photograph being displayed, but is also unique.

Accordingly, what is needed is an easy way for a person to personalize a picture frame to enhance the displayed photograph.

SUMMARY OF THE INVENTION

The present invention advantageously addresses the needs above as well as other needs by providing an assembly and method of personalizing a picture frame by customizing the frame such that the frame becomes an extension of the displayed photograph.

It is therefore a feature of the invention to provide a personalized photograph frame assembly that provides a frame that is an extension of the displayed photograph and is pleasing to the user. The frame can be custom made or purchased pre-made from the store. In the preferred embodiment, the frame is of the flat type and is covered with a portion of the photograph such that when the frame assembly is viewed in a plan view, the portion of the photograph covering the frame appears to be an extension of the photograph that is displayed in the frame.

The customized picture frame assembly consists of a picture frame having a flat face and a central opening. The frame may be of the pre-made variety with a glass piece (or other transparent medium) covering the opening and a removable backing that can be removed to insert a photograph to be displayed in the opening. The photograph to be displayed has been separated into two portions, a frame portion and the display portion. The frame portion is attached to and covers the front surface of the frame. The display portion is displayed in the opening of the frame. The frame portion and the display portion are separated by the thickness of the frame. When viewing the frame assembly in a plan view, the portions of the photograph appear as one, thus making it hard to distinguish between the frame portion and the display portion of the photograph (i.e., the frame and the photograph look as one since they are made from the same photograph). It is only when the customized picture frame assembly is viewed at an angle, does it become apparent that the display portion and the frame portion of the photograph lie on different planes separated by the thickness of the frame.

It is another feature of the invention to disclose a method of making the personalized photograph frame assembly. Once a frame is selected for the photograph, the backing and the glass (or other transparent medium) are removed. Using the frame as a template, the photograph is trimmed to match the perimeter of the frame and the center of the photograph is trimmed by the central opening in the frame, thereby making a frame portion and a display portion of the photograph. The frame portion is permanently attached to the flat front of the frame using an adhesive. The personalized photograph frame assembly is then assembled with the display portion of the photograph positioned between the glass (or other transparent medium) and the backing. The display portion is aligned in the opening of the frame to correspond with the frame portion such that when the personalized photograph frame assembly is seen in a plan view, a person would be unable to distinguish between the display portion and the frame portion. It is only when the frame is turned does it become evident that both portions of the photograph lie in different planes.

It is a further feature of the invention to use two duplicate photographs, instead of one, for the personalized photograph frame assembly. In this way the trimming of the portions do not have to be as precise and the display portion may be larger than the opening to allow for slight misalignment of the display portion when the personalized photograph frame assembly is assembled together.

It is an additional feature of the invention to use a template, instead of the picture frame to avoid damage to the frame during the photograph trimming operation. The templates are made in standard frame sizes and openings and made out a durable material that can withstand multiple use, such as metal or more preferably, acrylic, plexiglass or plastic.

It is an added feature of the invention to use a computer image of the photograph instead of the original photograph in the personalized photograph frame assembly. The photograph is scanned into a computer and computerized photo enhancement techniques are to restore or enhance the photograph. It is envisioned that the present invention could be used with old precious photographs where there is only one copy and the owner does not want it damaged. Sometimes these old photographs are faded and torn. By scanning the photograph into the computer, the original may be protected and once in the computer, the photographs can be manipulated and restored and are printed on a high quality color printer to be used in the personalized photograph frame assembly.

It is a supplementary feature of the invention to provide a personalized photograph frame kit to assist a person in personalizing a photograph frame. The kit includes a set of instructions on the frame personalizing method, a plurality of templates for trimming the photograph (or duplicate photographs), an adhesive for attaching a frame portion of the photograph to the frame and the display portion of the photograph to the backing or glass (or other transparent medium) such that when the personalized photograph frame assembly is assembled, both portions of the photograph look like one in a plan view.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

Below is a list of reference numbers associated with the figures.

| No. | Component |
|---|---|
| 10 | Customized Picture Frame Assembly |
| 12 | Frame Portion of Photograph |
| 14 | Display Portion of Photograph |
| 16 | Frame |
| 18 | Front Surface of Frame |
| 20 | Central opening of Frame |
| 22 | Glass (or other transparent medium) |
| 24 | Backing |
| 26 | Stand |
| 28 | Wall Mount Bracket |

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figure 1:
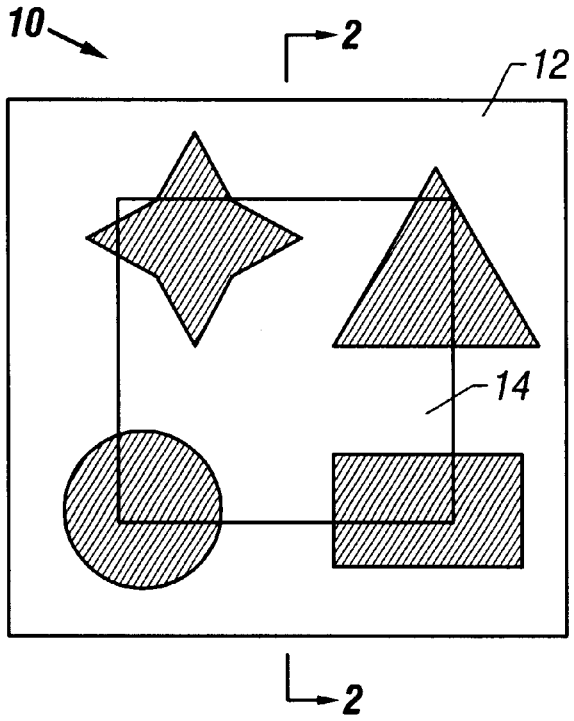
FIG. 1 is plan view showing the customized picture frame assembly of the present invention.
Figure 2:
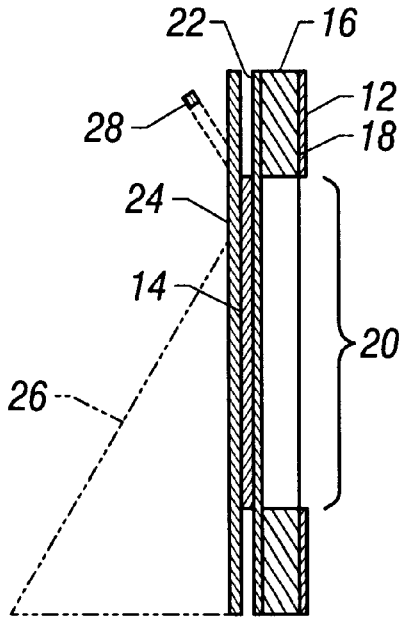
FIG. 2 is cross-sectional view of FIG. 1.
Figure 3:
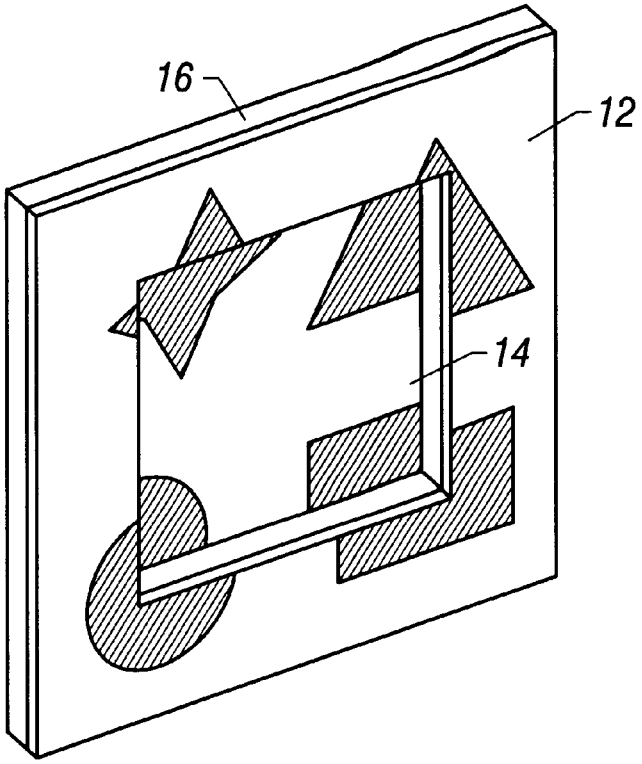
FIG. 3 is perspective view of the customized picture frame assembly of the present invention.

Referring first to FIG. 1, a plan view showing the present invention of a customized picture frame assembly 10 having a frame 16 that appears to be an extension of the displayed photograph. In the figures, the photograph is of geometric shapes consisting of a star, a triangle, a circle and a rectangle. These shapes are for demonstration only, the actual photographs will be those of the person personalizing the frame. FIG. 2 is a cross-sectional view of FIG. 1 showing the customized picture frame assembly 10 comprising a frame 16 having a flat face 18 and a central opening 20, an optional glass piece (or other transparent medium) 22 covering the opening 20, a backing 24 and a photograph that has been separated into two components, the frame portion 12 and the display portion 14. The frame portion 12 is used to cover the front surface 18 of the frame 16. The display portion 14 is displayed in the opening 20 of the frame 16. The frame portion 12 and the display portion 14 are separated by the thickness of the frame 16. When viewing the frame assembly 10 in a plan view (as in FIG. 1), it is hard to distinguish between the frame portion 12 and the display portion 14 of the photograph (i.e., the frame and the photograph look as one since they are made from the same photograph). It is only when the customized picture frame assembly 10 is viewed at an angle, as in FIG. 3, does it become apparent that the display portion 14 and the frame portion 12 of the photograph lie on different planes separated by the thickness of the frame.

Figure 4:
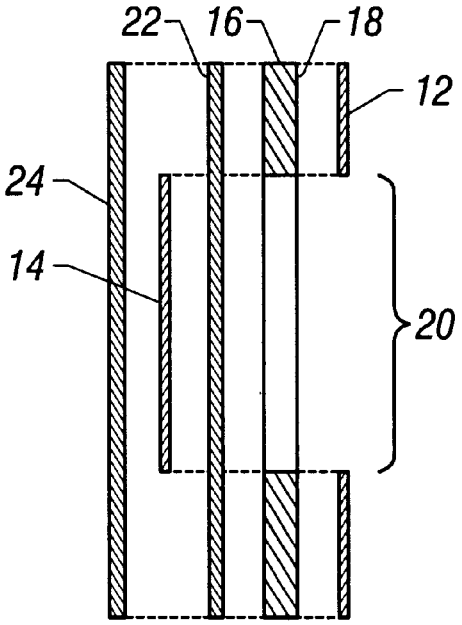
FIG. 4 is an exploded view of FIG. 2.

FIG. 4 shows an exploded view of FIG. 2. In this view, the various items of the present are shown depicting their relationship with each other. The frame 16 shown is a standard, ready-made frame that can be purchased in a store. Preferably, the frame has a flat face 18 for the frame portion 12 of the photograph to adhere to. The frame may be constructed of wood, metal or acrylic. Any thickness of frame may work, preferably the thickness should be between 0.1 inch and 0.5 inch. The frames may have a stand 26 for standing or a wall mount bracket 28 attached to the backing 24. The frames typically range in size from 2"×2" to 8"×10". The shape of the frame 16 can be square (as shown in the figures), oval, rectangular, round or custom shaped.

The customized picture frame assembly 10 uses a photograph chosen by the user. The outer dimension of the photograph must be larger than the frame 16 selected, because if the photograph is smaller, it will not cover the face of the frame 16 completely. As can be seen in figures, the photograph is separated into two portions, the frame portion 12 and the display portion 14. The frame portion 12 is sized to cover the front face 18 of the frame 16. The display portion 14 is used in the opening 20 of the frame 16. The trimming of the photograph into the 2 components may be done in a variety of ways, with the preferred method being a knife or blade. Once the photograph is separated, the frame portion 12 is attached to the front face 18 of the frame 16 with an adhesive and the display portion 14 is positioned in the central opening 20. When the portions of the photograph are assembled into the frame assembly 10, it is important that the two portions are in alignment when the frame assembly 10 is viewed in a plan view (as in FIG. 1).

The frame personalization process starts with selection of a frame 16 of appropriate size for the photograph (i.e., the frame is the same size or smaller than the chosen photograph). Once a frame 16 is selected, the backing 24 and glass (or other transparent medium) 22 are removed. While the present invention may be made using a single photograph, preferably, two duplicate photos are used. In this way the trimming of the portions does not have to be as precise. One of the duplicate photographs is positioned on a flat surface. The frame 16 is placed over the photograph with the front side down. The frame 16 is then used as a template to trim the photograph with a sharp knife or blade to the perimeter dimensions of the frame 16. Any nicks or scratches made in the frame 16 during the trimming may be repaired with a furniture pen or colored markers. Once the photograph is trimmed to the external shape of the frame, it is ready for attachment to the flat front 18 of the frame 16. In a preferred embodiment, the photograph is permanently attached to the flat front 18 of the frame 16 using an adhesive, such as a spray adhesive or mounting squares (double sided adhesive or tape). Once the photograph is attached to the frame 16, any excess of the photograph that overhang the edges of the frame 16 is trimmed. The frame 16 is then placed face down again on a flat surface. Using the inside edge of the frame opening 20 as a guide, the center of the first duplicate photograph is trimmed. Again, any scratches or nicks are fixed. The frame portion 12 of the first duplicate photograph is mounted on the face 18 of the frame 16. The second duplicate photograph (which now becomes the display portion 14) is then placed in the frame 16 to correspond with the frame portion 12. In other words, the second duplicate photograph is positioned in the frame 16 so that when the frame assembly 10 is view in a plan view, a person would be unable to distinguish between the interior second duplicate photograph and the exterior frame portion 12 of the first duplicate photograph mounted on the frame front 18 (i.e., the frame portion 12 is an extension of the displayed portion 14). Only when the frame is turned does it become evident that both portions of the photograph lie in different planes.

Since the second duplicate photograph is also the same size or larger than the frame 16, it may become necessary to trim it. In an alternate embodiment, the removed portion of the first duplicate photograph (trimmed from the opening 20) is used as a template for the display portion 14 to be cut from the second duplicate photograph. In this way, it can be certain that the second duplicate photograph will be complimentary with the first duplicate photograph. The center removed portion of the first duplicate photograph is placed over the second duplicate photograph in the same location. The second duplicate photograph is then trimmed such that it is approximately 0.125 inches larger on each side than that of the portion of the first duplicate photograph trimmed in the center opening 20. In other words, the second duplicate photograph is trimmed 0.125 inch larger than the center opening 20 of the frame 16. The trimming may be done with a scissors or paper cutter or the like. The trimmed second photograph (which is now the display portion 14 of the photograph) is then ready to be used in the frame assembly 10. For assembly, the glass (or other transparent medium) 22 is placed on the rear of the frame 16. The display portion 14 (e.g., the trimmed second duplicate photograph) is placed between the glass (or other transparent medium) 22 and the backing 24, while the backing 24 is secured to the frame 16. The customized frame assembly 10 is now ready for use.

Sometimes using the picture frame as a template to cut the photographs may be difficult and may damage the frame. To avoid damaging the frame, in a preferred embodiment, templates are made of the standard frame sizes and openings. These templates are made out of a durable material that can withstand multiple use, such as metal or more preferably, acrylic, plexiglass of plastic. During the photograph trimming, the templates are used to trim the photograph into the frame portion 12 and the display portion 14.

In place of an original photograph, a computer image may be used. Photographs may be scanned into a computer and computerized photo enhancement techniques may restore or enhance the photograph. One such program is Photoshop® from Adobe Corporation. It is envisioned that the present invention could be used with old photographs. Usually, only one copy of these precious photographs is available and the owner does not want it damaged. Sometimes these old photographs are faded and torn. By scanning the photograph into the computer, the original may be protected and once in the computer, the photographs can be manipulated and restored. They are then printed on a high quality color printer and used as described above in the customized frame assembly 10.

It is further envisioned that a kit may be provided to a person that would assist them in personalizing a photograph frame 16. The kit would include a set of instructions on the method of personalizing a frame (as described above). The kit may also include a plurality of templates along with a blade or knife for separating the photograph or duplicate photographs into a frame portion and a display portion. The templates are sized to correspond with standard ready made frames so that the inexperienced person will not damage the frames while trimming the photographs. Additionally, the kit could include an adhesive for attaching the display portion of the photograph to the frame surface.

While a frame is described for use with a photograph, this same technique can be used on a variety of items that are used to display photographs, such as curio boxes, photo magnets, bookends, scrapbooks/photo album covers, desk cube/pencil holders, music boxes, frames with trim (cutouts), bookrack, planters, jewelry boxes, pendants, Christmas ornaments, puzzles, recipe holders, lamp bases and the like.

While the invention herein disclosed has been described by means of specific embodiments and applications thereof, numerous modifications and variations could be made thereto by those skilled in the art without departing from the scope of the invention set forth in the claims.

What is claimed is:

1. A method of personalizing a photograph display frame comprising the steps of:

(a) providing a photograph display frame having a perimeter, a central opening, a front surface, a rear surface and a thickness;

(b) providing a photographic image depicted in two portions, a first portion sized to cover the front surface of the frame and a second portion sized to at least fit the central opening of the frame;

(c) attaching the first portion to the frame;

(d) positioning the second portion in the opening separated at least by the thickness of the frame from the first portion such that the first portion and second portion appear as one continuous photographic image without a discontinuity therebetween in plan view alignment; and (e) positioning a transparent piece between the rear surface of the frame and the second portion, such that the second portion is viewable through the transparent piece.

2. The method of claim 1 wherein the first portion and the second portion of the photographic image are from a photograph.

3. The method of claim 2 wherein an inside edge of the photograph display frame is used to separate the first portion from the second portion from the single photograph.

4. The method of claim 2 wherein a template is used to separate the first portion and the second portion from the photograph.

5. The method of claim 1 wherein the first portion of the photographic image is from a peripheral portion of a photograph.

6. The method of claim 5 wherein a first template is used to separate the first portion from the photograph.

7. The method of claim 1 further including the step of:

(f) attaching a backing to the frame such that the backing holds the transparent piece and the second portion to the rear surface of the frame.

8. The method of claim 1 wherein the second portion of the photographic image is from an interior portion of a photograph.

9. The method of claim 8 wherein a second template is used to separate the second portion from the photograph.

10. The method of claim 8 wherein the second portion of the photographic image is larger than the centrial opening in the photograph display frame.

11. The method of claim 1 wherein the first portion of the photographic image is from a peripheral portion of a duplicate of the photograph.

12. The method of claim 11 wherein the second portion is from an interior portion of another duplicate of the photograph.

13. A method of personalizing a photograph display frame comprising the steps of:

(a) providing a photograph display frame having a perimeter, a central opening, a front surface, a rear surface and a thickness;

(b) providing a photographic image depicted in two portions, a first portion sized to cover the front surface of the frame and a second portion sized to at least fit the central opening of the frame;

(c) attaching the first portion to the frame;

(d) positioning the second portion in the opening separated at least by the thickness of the frame from the first portion such that the first portion and second portion are in plan view alignment;

(e) positioning a glass piece between the rear surface of the frame and the second portion, such that the second portion is viewable through the glass piece;

wherein the positioning step comprises positioning the second portion in the opening separated at least by the thickness of the frame from the first portion such that the first portion and second portion appear as one continuous photographic image without a discontinuity therebetween in plan view alignment.

14. The method of claim 13 further including the step of:

(f) attaching a backing to the frame such that the backing holds the glass piece and the second portion to the rear surface of the frame.

* * * * *